US012285078B2

(12) United States Patent
Guer

(10) Patent No.: US 12,285,078 B2
(45) Date of Patent: Apr. 29, 2025

(54) SPORTS SHOE INCLUDING AN OPTIMIZED MOUNTING MIDSOLE

(71) Applicant: GGROW UP, Marseilles (FR)

(72) Inventor: Jean-Luc Guer, Marseilles (FR)

(73) Assignee: GGROW UP, Marseilles (FR)

( * ) Notice: Subject to any disclaimer, the term of this patent is extended or adjusted under 35 U.S.C. 154(b) by 236 days.

(21) Appl. No.: 17/292,980

(22) PCT Filed: Nov. 12, 2019

(86) PCT No.: PCT/EP2019/081072
§ 371 (c)(1),
(2) Date: May 11, 2021

(87) PCT Pub. No.: WO2020/099436
PCT Pub. Date: May 22, 2020

(65) Prior Publication Data

US 2022/0031012 A1 Feb. 3, 2022

(30) Foreign Application Priority Data

Nov. 12, 2018 (FR) ..... 1860442

(51) Int. Cl.
*A43B 7/144* (2022.01)
*A43B 13/16* (2006.01)
*A43B 13/41* (2006.01)

(52) U.S. Cl.
CPC ..... *A43B 7/144* (2013.01); *A43B 13/16* (2013.01); *A43B 13/41* (2013.01)

(58) Field of Classification Search
CPC ..... A43B 7/144; A43B 13/02; A43B 13/16; A43B 13/41
See application file for complete search history.

(56) References Cited

U.S. PATENT DOCUMENTS 2,352,532 A * 6/1944 Ghez ..... A43B 13/141 36/141
4,364,188 A * 12/1982 Turner ..... A43B 5/06 36/31

(Continued)

FOREIGN PATENT DOCUMENTS

FR 2 945 917 A1 12/2010
FR 2 967 874 A1 6/2012

(Continued)

OTHER PUBLICATIONS

International Search Report as issued in International Patent Application No. PCT/EP2019/081072, dated Feb. 6, 2020.

*Primary Examiner* — Bao-Thieu L Nguyen
(74) *Attorney, Agent, or Firm* — Pillsbury Winthrop Shaw Pittman LLP

(57) ABSTRACT

A sports shoe having an upper, an insole and a sole, the insole being secured to the sole, extending in a longitudinal direction and having an anterior part that is able to receive the forefoot, a central part that is able to receive the midfoot, and a posterior part; wherein the posterior part and the central part of the insole are made of a rigid material, and wherein the sports shoe has a cushioning element positioned in the posterior part of the insole, the cushioning element being able to cushion and receive the heel.

13 Claims, 3 Drawing Sheets

(56) References Cited

U.S. PATENT DOCUMENTS

| | | | | | |
|---|---|---|---|---|---|
| 4,794,707 | A * | 1/1989 | Franklin | A43B 7/148 | 36/31 |
| 4,854,057 | A * | 8/1989 | Misevich | A43B 13/12 | 36/31 |
| 5,547,620 | A * | 8/1996 | Guiotto | B29C 44/1214 | 264/273 |
| 5,926,975 | A * | 7/1999 | Goodman | A43B 13/16 | 36/31 |
| 6,038,790 | A * | 3/2000 | Pyle | A43B 7/144 | 36/28 |
| 10,010,135 | B2 * | 7/2018 | Lovell | A43B 13/188 | |
| 10,285,470 | B2 * | 5/2019 | Morag | A43B 13/122 | |
| 10,531,701 | B2 * | 1/2020 | Guer | A43B 5/02 | |
| 2003/0172548 | A1 * | 9/2003 | Fuerst | A43B 13/026 | 36/28 |
| 2004/0181970 | A1 * | 9/2004 | Covatch | A43B 17/00 | 36/28 |
| 2011/0000101 | A1 * | 1/2011 | Nakano | B29D 35/10 | 12/146 B |
| 2013/0333249 | A1 * | 12/2013 | Guer | A43B 7/144 | 36/134 |
| 2017/0202306 | A1 * | 7/2017 | Do | A43B 13/20 | |
| 2017/0360147 | A1 * | 12/2017 | Zake | A43B 7/141 | |
| 2021/0093040 | A1 * | 4/2021 | Yoshida | A43B 13/04 | |
| 2022/0346492 | A1 * | 11/2022 | Jenkins | A43B 13/026 | |
| 2022/0378145 | A1 * | 12/2022 | Tateno | A43B 13/125 | |

FOREIGN PATENT DOCUMENTS

| | | | |
|---|---|---|---|
| GB | 2 124 473 | A | 2/1984 |
| WO | WO 2005/016049 | A1 | 2/2005 |

* cited by examiner

SPORTS SHOE INCLUDING AN OPTIMIZED MOUNTING MIDSOLE

CROSS-REFERENCE TO RELATED APPLICATIONS

This application is the U.S. National Stage of PCT/EP2019/081072, filed Nov. 12, 2019, which in turn claims priority to French patent application number 1860442 filed Nov. 12, 2018. The content of these applications are incorporated herein by reference in their entireties.

TECHNICAL FIELD OF THE INVENTION

The field of the invention is that of shoes, in particular used for the practice of a physical activity, and in particular for the practice of sport whether urban or outdoors.

PRIOR ART

Sports activities such as walking, jogging and running are activities practiced on a regular basis, even daily, for some people. This activity causes repeated impacts at the feet, impacts which are transmitted to the joints of the stem stages and which are known to favour in the short, medium or long term the appearance of Musculo-Skeletal Disorders (MSDs).

These MSDs can range from simple pain to disabling injuries such as fatigue fractures, severe wear of cartilage or tendonitis, which forces the person to reduce, and even in certain cases, stop their practice. These disorders can be cared for, but lead to reoccurrences in most cases.

To limit the risk of the appearance or recurrence of MSDs linked to the practice of sports, it is imperative to control the unfolding of the step so as to maintain a kinematics of the foot that optimises the yield and that limits the deleterious effects (pressure peaks, vibrations, instabilities). This control can be done conscientiously, by an informed practicer, and it can also be facilitated by using a suitable shoe.

Shoes form the main equipment of the athlete (walking and running), and are increasingly specific to a practice and to a sport. They must make it possible to respond to certain needs linked to the sports activity, particularly in terms of adherence, the type of impact and movement expected. Thus, for example, manufacturers favour a more cushioning sole for a running shoe on hard ground, or a sole and a wrapping of the foot that are stiffer for a hiking shoe on soft ground.

Although these improvements make it possible to improve the general comfort of the athlete as well as their performance, all these specificities often make for losing sight of the fundamental physiological and biomechanical aspect of the foot.

Indeed, beyond the impact of the heel, it is the entire kinematics (or unfolding) of the step that is capital and which has to comply with certain rules.

DISCLOSURE OF THE INVENTION

In this context, the invention aims to propose a sports shoe comprising an stem, an mounting midsole and a sole, the mounting midsole being secured to the sole, extending in a longitudinal direction and having an anterior part that is able to receive the forefoot, a central part that is able to receive the midfoot and a posterior part; said sports shoe being characterised in that the posterior part and the central part of the mounting midsole are made of a rigid material and in that the sports shoe has a cushioning element positioned in the posterior part of the mounting midsole, said cushioning element being able to cushion and receive the heel.

Rigid material means a material that has a hardness greater than or equal to 65 Shore A or 20 Shore D. Thus, it can easily be defined that a thermoplastic or thermosetting material is a hard material according to the definition given by the invention.

Soft material means a material having a hardness less than or equal to 50 Shore A. Thus, it can easily be defined that an elastomer material, a silicone or a foam of the EVA type is a soft material according to the definition given by the invention.

Thus, the shoe according to the invention goes against the teaching of the prior art which recommends for the realisation of an mounting midsole, the use of flexible and comfortable materials, such as for example leather. A flexible and comfortable mounting midsole is often perceived as a token of quality and of the solidity of the shoe.

In addition to the characteristics mentioned in the preceding paragraph, the sports shoe according to the invention can have one or more additional characteristics among the following, taken individually or according to any technically permissible combination:

- the posterior part and the central part of the mounting midsole are made of a material that has a hardness greater than or equal to 20 Shore D;
- the posterior part and the central part of the mounting midsole are made of a thermoplastic or thermosetting material;
- the cushioning element is made of a material that is more flexible than the rigid material of the central part and of the posterior part of the mounting midsole;
- the cushioning element is made of a material that has a hardness less than or equal to 50 Shore A;
- the cushioning element has a thickness comprised between 1 and 25 mm forming a posterior elevation of the heel with respect to the forefoot;
- the cushioning element rests on the upper face of the posterior part of said mounting midsole;
- the central part of the mounting midsole comprises an upper profile and a lower profile that are curved, in such a way that the central part forms an arch extending between the posterior part and the anterior part of the mounting midsole;
- the central part of the mounting midsole comprises a curved upper profile configured to hug the shape of the arch of the foot;
- the central part of the mounting midsole has cushioning and rebound properties;
- the anterior part of the mounting midsole is formed by a textile material or a piece of leather or a cardboard material;
- the anterior part of the mounting midsole comprises at least one groove or cut-out creating a primer in order to favour the folding of the anterior part;
- said at least one groove or cut-out is arranged in a flexing zone dimensioned and oriented in such a way as to correspond to a contact zone receiving all the metatarsal heads of the foot;
- the sole comprises an anterior part, a central part and a posterior part, said sole having in the anterior part a preferred flexing zone extending in an oblique direction with respect to the longitudinal direction of the sports shoe;

said preferred flexing zone arranged in the sole is dimensioned and oriented in such a way as to be located as a projection of the metatarsal phalangeal heads of the foot.

Furthermore, the shoe according to the invention can also have one or more additional characteristics among the following, taken individually or according to any technically permissible combination:

the sole has in the anterior part a plurality of preferred flexing zones extending in an oblique direction with respect to the main axis of the foot (P);

said sole has, in the preferred flexing zone, a hardness at least 10% lower with respect to the rest of said sole;

said preferred flexing zone has a height, extending in a longitudinal direction (L), comprised between 3 and 40 mm;

said preferred flexing zone is oriented according to a flexing fold axis principal (F), itself oriented according to an angle of 105°±15° with respect to the main axis of the foot (P);

said sole has, in the preferred flexing zone, at least one groove oriented according to the flexing fold axis principal (F);

said sole is made of a first material and has, in the preferred flexing zone, an inclusion of a second material of the same nature and having a density less than the density of the first material used for the rest of the sole;

the second material has a density at least 10% less than the density of the first material;

said sole is made of a first material and has, in the preferred flexing zone, an inclusion of a second material of a different nature and having a hardness less than the hardness of the first material used for the rest of the sole;

the second material has a hardness at least 10% less than the hardness of the first material;

said preferred flexing zone is located at a distance comprised between 60 and 75% of the total length of the sole from its rear end;

said preferred flexing zone extends over a portion or over the entire width of the sole;

said sole has a strip with extra thickness located at an edge of said preferred flexing zone or at two edges of said preferred flexing zone;

said strip with extra thickness is oriented according to the flexing fold axis principal (F), itself oriented according to an angle of 105°±15° with respect to the main axis of the foot (P);

said strip with extra thickness forms a means of gripping of the anterior part of the outsole;

said sole is a flexible sole with an elastomer base or a rigid sole with a thermoplastic material base;

said sole comprises an outsole intended to come into contact with the ground and a midsole, said preferred flexing zone extending in an oblique direction with respect to the main axis of the foot (P) being arranged at said outsole.

Advantageously, the shoe is a walking shoe, a running shoe, a sports shoe, a football shoe or a rugby shoe.

The invention and its different applications will be understood better when reading the following description and examining the accompany figures.

BRIEF DESCRIPTION OF THE FIGURES

Other characteristics and advantages of the invention shall appear when reading the following description, in reference to the accompanying figures, which show.

For increased clarity, identical or similar elements are marked with identical reference signs on all the figures.

DETAILED DESCRIPTION OF AN EMBODIMENT

Figure 1:
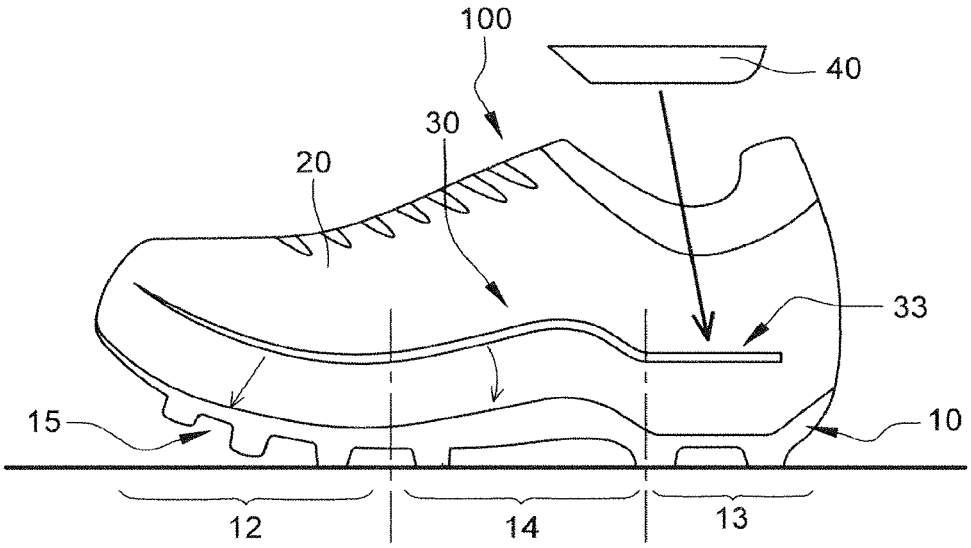
FIG. 1 diagrammatically shows an exploded view of a first embodiment of a sports shoe according to the invention.

FIG. 1 diagrammatically shows an exploded view of a first embodiment of a sports shoe according to the invention.

In the present application, median plane means the plane that separates the left half from the right half of the body. Sagittal plane means a plane parallel to the median plane. Transverse plane means a horizontal plane and therefore perpendicular to the median plane and that separates the body into a cranial portion and a caudal portion. Frontal (or coronal) plane means a plane perpendicular to the median plane and to the transverse plane and that separates the body into an anterior (ventral) part and a posterior (dorsal) part.

Conventionally, and as shown in FIG. 1, the sports shoe 100 according to the invention comprises an stem 20 delimiting a housing intended to receive a foot (not shown). The stem 20 is closed in the lower part by an mounting midsole 30 so as to form a complete volume to receive the foot.

The sports shoe 100 also comprises a sole 10 on which the mounting midsole 30 is secured. The mounting midsole 30 is for example sewn, glued, thermoglued, hot welded on the upper portion of the sole 10.

The sole 10 conventionally extends from the front to the rear of the shoe 100 along a longitudinal axis (L) that corresponds to the main axis of the foot (P).

Main axis of the foot (P), or static axis of the foot, means the axis that passes through the middle of the heel and through the middle of the second toe.

According to a first embodiment shown in FIG. 1, the sports shoe 100 is a walking shoe or a running shoe having a relatively flexible sole 10 formed from a base of materials known in the prior art in the field of walking or running shoes. These materials are, for example, foam materials and/or elastomer materials which are known to be soft materials (in opposition to hard materials of the thermoplastic or thermosetting type) having cushioning characteristics, and which are easily deformed under a simple pressure of the fingers.

The sole 10 forms the base of the sports shoe 100 and is intended to be in contact with the ground. The sole 10 conventionally extends from the front to the rear of the shoe 100.

The chaussure 100, and more particularly the sole 10 comprises three distinct parts that each fulfil a role in the maintaining and the positioning of the foot in the shoe 100:

a first part 12 located at the front of the shoe allowing for the support of the forefoot, called in what follows anterior part 12;

a second part 13 located at the rear of the shoe allowing for the support of the heel, called in what follows posterior part 13, and;

a third part 14 located between the two others that provides the support of the midfoot, named central part 14 in what follows.

Each one of the parts 12, 13, 14 is defined and dimensioned so as to form a global foot profile proposing a support for the foot that is the most enveloping possible and the closest as possible to the foot profile of the foot, thus preserving the anatomical and biomechanical balance of the athlete.

The sole 10 is comprised by the association of several layers and/or materials that have different properties (for example hardness, cushioning, etc.) that can be located locally at different places.

Thus, it is possible to conventionally define that the sole 10 is comprised of the association:

of a midsole on which the mounting midsole 30 is secured; and of an outsole, called wearing, intended to be in contact with the ground.

The midsole is comprised for example of foam or foams made of EVA and/or of foam or foams made of TPU the densities and the hardnesses of which can vary according to the needs. This midsole can also comprise structural reinforcements located facing the internal arch of the foot or located from the heel until the forefoot. However, the architecture according to the invention advantageously makes it possible to overcome the use of structural reinforcements located in the midsole by the presence of a structural mounting midsole.

The outsole is for example formed by one or more layers of elements from the following list: polyurethane; elastic thermoplastic polyurethane, rubber. The outsole is advantageously textured and can have means that favour gripping on a particular ground such as for example sculptures, flexible cleats of which the shape and the geometry can vary according to the programme of use of the sports shoe 100. Cleat is defined as an element, generally a more or less flexible protuberance, lining the outsole of sports shoes so as to provide better adherence on the ground according to the nature of the ground.

Conventionally, the sports shoe 100 also includes a sockliner (not shown) that covers the mounting midsole 30.

Figure 2:
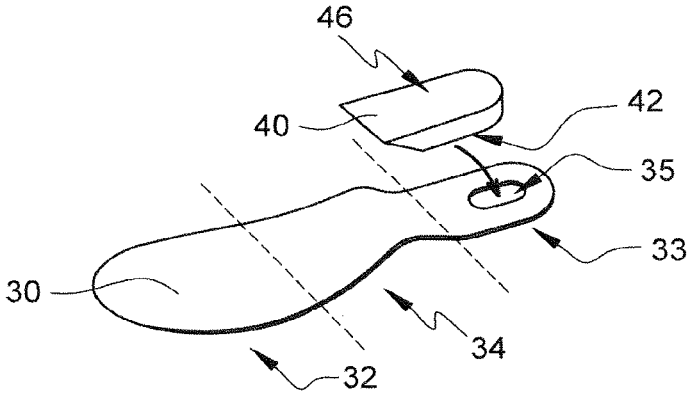
FIG. 2 shows a perspective view of a first embodiment of an mounting midsole according to the invention.

The mounting midsole 30 according to the invention is shown more specifically in FIGS. 1 and 2. Contrary to the known prior art, the invention proposes an mounting midsole 30 as a structural element of the sports shoe 100.

The mounting midsole 30 according to the invention has at least one part made of a hard material, (typically having a hardness greater than 65 Shore A), different from a foam material, an elastomer material, a textile material, pieces of leather, or any other type of material conventionally used for the realisation of an mounting midsole. Advantageously, the mounting midsole has a hardness greater than or equal to 20 Shore D or 80 Shore A.

The mounting midsole 30 according to the invention has, similar to the sole 10, a structure comprised of three parts:

a first part 32 located at the front of the shoe that participates in the support of the forefoot, named anterior part 32 of the mounting midsole 30 in what follows;

a second part 33 located at the rear of the shoe that participates in the support of the heel, named posterior part 33 of the mounting midsole in what follows, and a third part 34 located between the two other parts 32, 33 that participates in the support of the midfoot, named central part 34 of the mounting midsole 30 in what follows.

Each one of the parts 32, 33, 34 of the mounting midsole is defined and dimensioned so as to form a global foot profile proposing a support for the foot that is the most enveloping possible and the closest as possible to the foot profile of the foot, thus preserving the anatomical and biomechanical balance of the athlete.

According to a first embodiment, the central part 34 of the mounting midsole 30, as well as the posterior part 33 of the mounting midsole 30, are made of a hard material, i.e. having a hardness greater than or equal to 65 Shore A or 20 Shore D, while at least one region of the anterior part 32 of the mounting midsole is made of a soft material, i.e. having a hardness less than 50 Shore A, and flexible easily deformable, such as for example a textile material, a cardboard material, a material made of leather, or encore any other type of material conventionally used for the realisation of an mounting midsole or for the realisation of a sockliner according to the prior art.

According to an advantageous embodiment of the invention, the mounting midsole 20 has a hardness greater than or equal to 80 Shore A, or 30 Shore D.

The material used for the central part 34 of the mounting midsole 30 and the posterior part 33 of the mounting midsole 30 is for example a thermoplastic material or a thermosetting material.

The central part 34 of the mounting midsole 30 as well as the posterior part 33 of the mounting midsole 30 are advantageously made of a thermoplastic or thermosetting material having a certain elastic deformation (of about a few millimetres) and capable of absorbing and dissipating substantial impact energies and resisting the mechanical stressed imposed on the shoe during the use thereof for walking or running.

The central part 34 of the mounting midsole 30 as well as the posterior part 33 of the mounting midsole 30 are advantageously made of polyamide, a composite material with glass or carbon reinforcing fibres.

The posterior part 33 of the mounting midsole 30 is substantially flat and of a constant thickness $e_1$. The posterior part 33 has a thickness $e_1$ of a few millimetres, advantageously greater than 1.5 mm, and preferably comprised between 2 and 8 mm in such a way as to have a sufficient rigidity of the posterior part 33 to not be deformed under the weight of the athlete.

Figure 4:
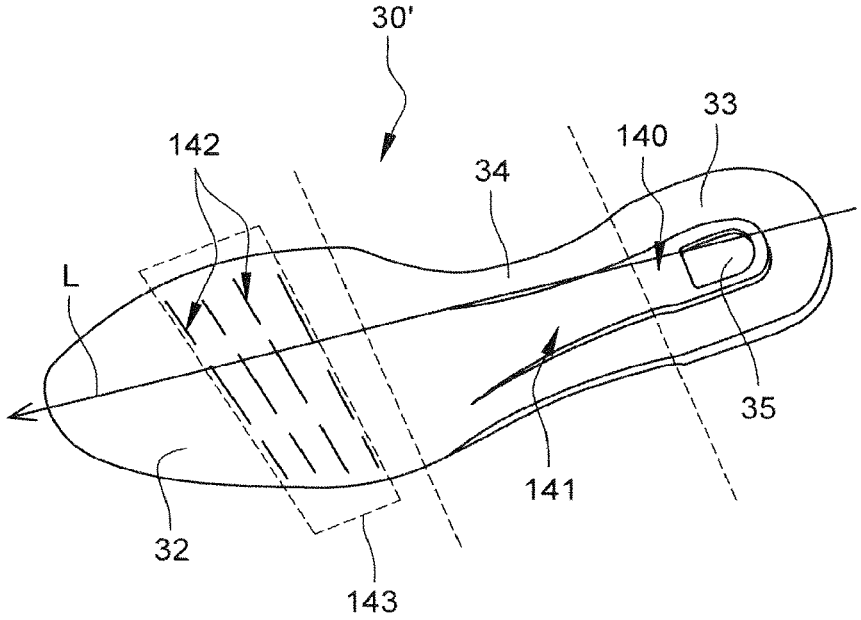
FIG. 4 shows a bottom view of a second embodiment of an mounting midsole according to the invention.

According to an alternative embodiment shown in FIG. 4, showing a bottom view of a second embodiment of an mounting midsole 30' according to the invention, the posterior part 33 can have a structural reinforcement 140 at its lower face (i.e. at the face directed facing the sole 10) realised by a localised extra thickness, or by the insertion of a material that has mechanical characteristics that are different from the mechanical characteristics of the material used for the realisation of the posterior part 33 of the mounting midsole 30'. According to the embodiment shown in FIG. 4, the structural reinforcement 140 is positioned in a central region of the posterior part 33, with respect to a median plane of the posterior part 33.

Advantageously, using a localised extra thickness at the posterior part 33 also makes it possible to vary out a shimming function that facilitates the pre-positioning of the mounting midsole 30' on the sole 10 during the assembly of the shoe 100.

The central part 34 of the mounting midsole 30 includes a curved upper profile and lower profile, in such a way that the central part 34 forms an arch extending between the posterior part 33 and the anterior part 32 of the mounting midsole 30. This central part 34 in the shape of an arch is able to receive and support the foot arch of the foot.

The curving or the camber of the arch of the central part 34 varies according to the transversal axis of the shoe 100 so as to best hug the shape of the foot arch of the midfoot and to support it suitably. The central part 34 has a more substantial camber at its internal profile than at its external profile so as to best support the arch of the midfoot of which the internal arch has an arching effect that is greater than that of its external arch.

The internal and external longitudinal cambers of the central part 34 make it possible to better contain and better envelope the longitudinal arches of the foot and thus increase the bearing surface of the plantar fulcrums limiting the fatigability of the athlete. The loads and the pressures on the foot are then better distributed during walking, running, jumping, taking of support on the ground, changes in direction, etc.

The posterior region of the central part 34 (i.e. the region in the vicinity of the posterior part 33) has at least one portion having a thickness $e_2$ equivalent to the thickness $e_1$ of the posterior part 33 of the mounting midsole 30. This portion advantageously forms a junction between the posterior part 33 and the central part 34 of the mounting midsole 30.

The thickness of the central part 34 can be constant in this entire part, or have a progressive refining from the rear towards the front of the mounting midsole 30, in such a way that the central part 34 has, at its anterior region (i.e. in the vicinity of the anterior part 32) a thickness $e_3$ less than the thickness $e_2$.

The particular camber of the arch of the central part 34 as well as its thickness (constant or refining in the direction of the anterior part 32 of the mounting midsole 30) are configured to support the natural arch of the foot as well as to allow for a slight elastic deformation of this portion (of about 1 or 2 millimetres) during walking, jumping, or running, under the weight of the user. The elastic deformation of this arch of the central part 34 makes it possible to create an additional cushioning to cushion the shock wave caused by the impact of the shoe on the ground, during walking and especially during running, and makes it possible to realise a return (rebound) of the energy stored during the cushioning phase so as to improve the following propulsion phase.

The particular camber of the arch of the central part 34 thus preserves the biomechanical activity of the foot arches of the midfoot so as to optimise the physiological qualities of the foot as a whole, i.e. stability, absorption of shocks, elasticity, propulsion and drainage.

According to the alternative embodiment shown in FIG. 4, the central part 34 can also have a structural reinforcement 141, positioned at its lower face (i.e. directed facing the sole 10). This structural reinforcement 141 is carried out by a localised extra thickness, or by the inserting of a material having mechanical characteristics that are different from the mechanical characteristics of the material used for the realisation of the central part 34 of the mounting midsole 30'. According to the embodiment shown in FIG. 4, the structural reinforcement 141 is positioned in a central region of the central part 34 of the mounting midsole 30', in relation to a median plane of the central part 34. Identically to the thickness of the central part 34, the thickness of the extra thickness can also be variable and have a thinning towards the front of the mounting midsole 30.

The anterior part 32 of the mounting midsole 30 is made of a material different from the central part 34 and from the posterior part 33 of the mounting midsole 30. The anterior part 32 is made of a flexible material, such as a textile material, one or several pieces of leather, a cardboard material, or any other material conventionally used for its relative flexibility for the realisation of such an mounting midsole.

The anterior part 32 has a low thickness $e_4$ that is lower than the thicknesses of the central 34 and posterior 33 parts, for example by a few millimetres (preferably less than 3 mm), substantially constant except at the periphery thereof which is slightly raised in order to be fastened to the stem 20 by ad hoc means of fastening such as gluing or overmoulding.

The anterior part 32 has a slightly curved surface profile of which the front portion is slightly raised in relation to its rear portion, in such a way as to have maximum support on the ground during digitigrade phase, i.e. during the period, during walking or running, during which the support of the foot is conditioned on the forefoot.

This anterior part 32 makes it possible to receive the forefoot, and more precisely the anterior transversal arch as well as the anterior supports substantially formed by the heads of the first metatarsal and of the fifth metatarsal.

According to a first embodiment, the mounting midsole 30 is formed by the assembly of the anterior part 32 on the one hand and of a single-piece element forming the central part 34 and the posterior part 33 on the other hand. The assembly is carried out for example by sewing, by gluing, by thermowelding, or other ad hoc means, then the whole is secured to the sole 10 as announced hereinabove.

This embodiment is particularly well suited when the central part 34 and the posterior part 33 are made of thermoplastic or of composite materials with a thermosetting material base and the anterior part 32 is a textile part, or a part made of leather for example.

According to a second embodiment, the central part 34 and the posterior part 33 are directly injected by melting or overmoulding at the anterior part 32 in such a way as to obtain a single-piece mounting midsole 30 with a central and posterior part made of a hard material and an anterior part 32 made of flexible material. This second embodiment is particularly advantageous, when a cardboard material is used for the realisation of the anterior part 32 of the mounting midsole 30.

According to the type of material used for the anterior part 32 of the mounting midsole 30, it is provided to realise at least one transversal groove or cut-out 142, for example partial (i.e. in dotted lines) in a flexing zone 143 corresponding to the flexing fold of the foot in order to favour the folding of the anterior part 32. In the embodiment shown, the anterior part 32 includes four grooves, or cut-outs, 142. These grooves, or cut-outs, 142 are particularly useful and advantageous when the material used by the anterior part 32 is a cardboard material having a rigidity that is greater than the rigidity of the textile.

This flexing zone 143 is advantageously chosen and corresponds to the contact zone of all the metatarsal phalangeal heads of the foot. The transversal grooves 142 are grouped together in this flexing zone 143 that extends over a portion (not shown) or on either side of the mounting midsole 30 (i.e. between the interior and the exterior of the mounting midsole 30). Typically, this flexing zone 143 originates at the rear of the necks of the heads of the metatarsals (and advantageously up to a maximum of 2 cm at the rear according to the type of shoe) and terminates at the front of the metatarsal heads (and advantageously up to a maximum of 2 cm at the front according to the type of shoe). The flexing zone 143 as well as the grooves 142 are oriented according to an oblique flexing fold axis F with respect to the longitudinal axis L of the shoe 100.

Figure 5:
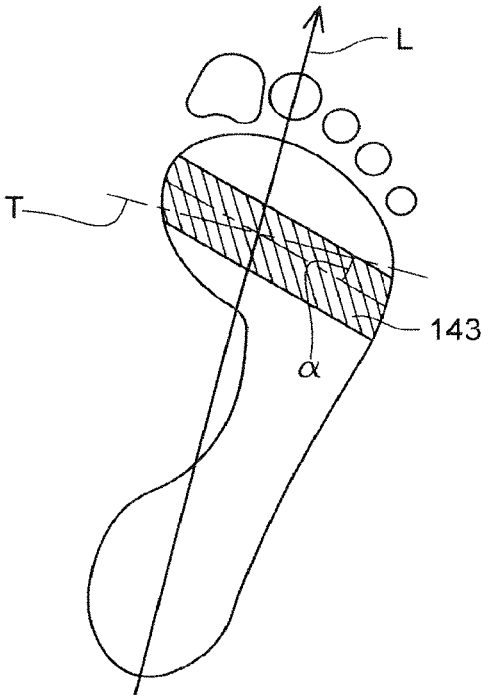
FIG. 5 shows a projection on the foot of the flexing zone arranged at the mounting midsole shown in FIG. 4.

FIG. 5 shows a projection on the foot of this flexing zone 143 arranged at the mounting midsole 30.

The flexing zone 143 is located at a distance comprised between 60 and 70% of the total length of the mounting midsole 30 in relation to the posterior end of the mounting midsole 30.

This obliquity of the flexing zone 143 in relation to the longitudinal axis L is directly related to the support zone of the anterior arch of the foot. The grooves 142 arranged in this flexing zone 143 also follow this general orientation in such a way that the grooves 142 are oriented obliquely in relation to the longitudinal axis L, with an angle $\alpha$ of 105°±15° in relation to the longitudinal axis L, (i.e. according to an angle of 15°±15° with respect to the transverse axis T perpendicular to the longitudinal axis L) as shown in the figure.

This arrangement of the transversal grooves 142 of the mounting midsole 30 in this particular flexing zone 143 creates a primer that makes it possible to facilitate the folding of the shoe during the lateral unfolding of the anterior arch (by the exterior of the 5th metatarsal head to the 1st metatarsal head) during walking and taking support, like a genuine guide rail.

In a complementary manner, the sole can also comprise in its anterior part, at least one preferred flexing zone making it possible to favour and to guide the folding of the shoe during the unfolding of the foot in a particular zone, chosen and predefined of the anterior part of the sole. Advantageously, this flexing zone of the sole is realised at the same level as the flexing zone 143 of the mounting midsole 30, in order to further optimise the conducting of the movement of the step during walking, or running, in the most efficient way possible by minimising the resistance of the shoe during the unfolding of the foot.

At this flexing zone, the sole typically has a hardness that is less than the rest of the sole. Advantageously, the hardness at this flexing zone is at least 10% less than the hardness of the rest of the sole.

By way of example, the reduction in the hardness of the sole can be realised by creating transversal grooves (not shown) arranges at the forefoot of the outsole 14. Thus, these transversal grooves of the outsole and of the mounting midsole 30 make it possible to improve the supports and to optimise the unfolding of the foot during walking or running, and to improve the general balance of the athlete with a functional activity that is safer and more economical.

According to an alternative embodiment, the sole 10 can include at this preferred flexing zone at the forefoot, an inclusion of a material M2 having characteristics that are different from the material M1 used for the rest of the sole 10 (i.e. for the posterior part, the central part and the anterior part outside of the flexing zone).

This second material M2 can be introduced into the outsole 15, or into the midsole, when the hardness of the sole 10 in this flexing zone is decreased by at least 10%.

According to a first alternative embodiment, the material M2 is of the same nature as the material M1 and has a density less than the material M1, typically a density less than 10%. According to a second alternative embodiment, the material M2 is of a nature different from the material M1 and has a hardness less than the material M1, typically a hardness less than 10%.

The posterior part 33 of the mounting midsole 30 is supplemented by a cushioning posterior element 40 made of a cushioning material making it possible to cushion the shocks and the impacts of the heel during walking or running. The cushioning element 40 makes it possible to prevent the risks of injuries and the rising of shock waves into the musculoskeletal system during walking or running.

According to a first embodiment, shown in FIGS. 1 and 2 the cushioning posterior element 40 is a removable heel-piece that bears against the upper flat surface of the posterior part 33 of the mounting midsole 30.

The removable heel-piece 40 includes a protuberance 42, on its lower face, configured to cooperate with a housing 35 arranged in the posterior part 33 of the mounting midsole 30. The cooperation of the protuberance 42 and of the housing 35 makes it possible to provide the positioning and the maintaining of the removable heel-piece 40 in longitudinal translation and in transversal translation at the posterior part 33.

According to another embodiment (not shown), the cushioning posterior element is directly overmoulded on the mounting midsole at the posterior part 33 of the mounting midsole 30. More precisely, the cushioning posterior element is overmoulded on the upper face of the mounting midsole 30 (i.e. oriented towards the interior of the stem 20).

Figure 3:
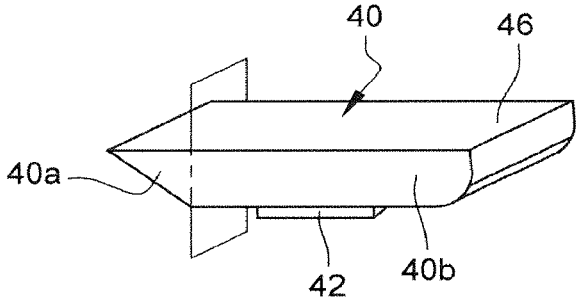
FIG. 3 shows an embodiment of a cushioning element according to the invention.

As shown in FIGS. 1 to 3, the upper face 46 of the cushioning element 40 is substantially flat.

The cushioning element 40 has a minimum base thickness that procures the posterior elevation of the heel with respect to the forefoot. The thickness of the cushioning element 40 is globally constant in its main portion 40*a* (portion contained in the posterior part 33 of the mounting midsole 30) then progressively decreases towards the front in its extension portion 40*b* (portion contained in the central part 34 of the mounting midsole 30) according to a straight or substantially concave bevelled profile.

The cushioning element 40 fills in the volume above the posterior part 33 of the mounting midsole 30 inn such a way as to create a posterior elevation that positions the foot according to an optimised angle during the taking support phase. The cushioning element 40 fills in all the heel surface of the mounting midsole 30.

The cushioning element 40 can be obtained from an elastic polymer material, or other, chosen for its mechanical properties in order to provide an additional characteristic to the sports shoe 100.

For example, the cushioning element 40 is made of a slightly flexible and deformable material, such as a cross-linked foam, an elastomer in such a way as to provide the shoe 100 with a cushioning function.

The cushioning element 40 can also comprise bubbles, cells or even tubular recesses and/or springs in order to improve the cushioning, anti-vibration, and/or return functions.

The cushioning element 40 can also comprise on its upper surface 36 different asperities, reliefs, grooves, cells or pins defined according to the proprioceptive interest sought. The presence of pins makes it possible for example to stimulate the foot receptors so as to arouse the proprioceptive balance of the rearfoot, and thus encourage the work of the lateral stabilisers of the ankle for a user having for example repetitive sprains.

The cushioning element 40 can also be formed by the association of several separate materials. It can in particular be formed by a plurality of superimposed layers, for example in the thickness, along a longitudinal axis, or along a transversal axis, of different materials that have different mechanical properties (qualities concerning cushioning, stability, shock wave absorption, or absorption of vibrations that generate various mechanical pathologies).

Thus, the cushioning element 40 makes it possible to provide, by a clever and strategic choice of a material or of a mixture of materials, properties concerning cushioning, but also stability, absorption of shock waves that are detrimental to the anatomical structures or absorption of vibrations that generate various functional pathologies in athletes.

All of these properties mentioned are all the more so effective and perceptible by the athlete when the base on which the cushioning element 40 bears is a base that is structurally rigid, hardly deformable, and stable regardless of the nature of the ground. There is therefore no loss of effectiveness.

The removable nature of the cushioning element can furthermore be easily replaced by the interior of the stem 20. It is sufficient for the user to insert their hand inside the stem 20 through the opening thereof, to lift the sockliner (not shown in the figures) that generally covers the entire mounting midsole 30, then to remove the cushioning element 40 from its housing 35 and to replace it with another cushioning element having different or additional mechanical properties.

The removable cushioning element 40 can also have on the surface, different indications (colour codes, denominations) on its mechanical properties, which allows the user to select from among others according to the characteristics sought (for example, flexibility or on the contrary rigidity), according to the weight, or the programme sought.

The removable cushioning element 40 forms an entirely modulable and customisable element in terms of its mechanical properties as well as its aesthetic aspect.

The cushioning element has a thickness comprised between 1 and 25 mm (and more preferably between 10 and 15 mm) so as to provide an optimal elevation of the heel with respect to the forefoot.

The mounting midsole 30 according to the invention has for vocation to create a rigid structure at the central and posterior part of the shoe, that is hardly deformable, or at least with a controlled deformation at the central part 34. The mounting midsole 30 thus forms a "rigid chassis" of the shoe 100, positioned between the foot and the sole 10 which is flexible and deformable. The mounting midsole 30 thus forms a support that is stable, repeatable and durable for the midfoot and the heel during walking or running, while the sole 10 plays its role of cushioner, being deformed and fully carrying out its role of adaptability to the constraints of the ground without the biomechanical structure of the foot being affected by these differences in support linked to the nature of the ground, the mounting midsole 30 on which the foot is bearing against remaining dimensionally stable.

Figure 6:
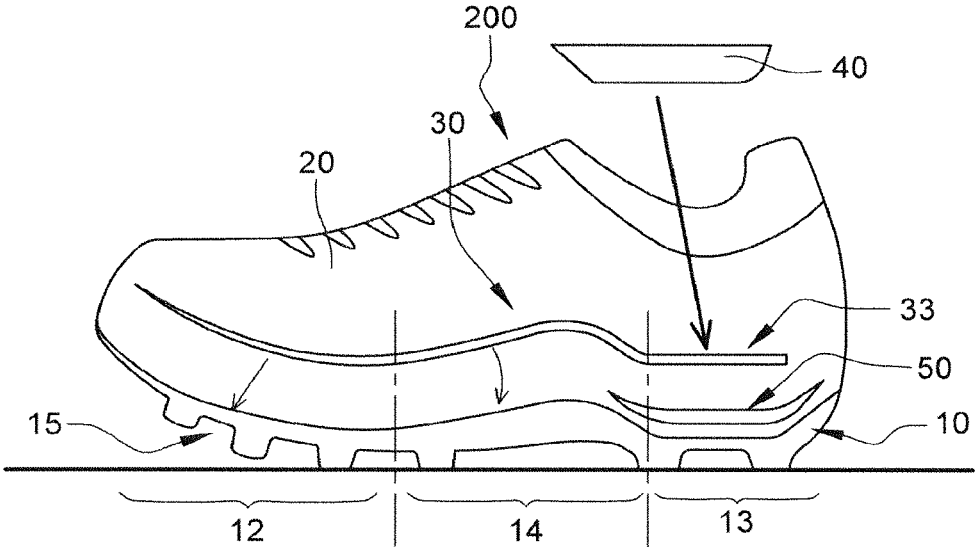
FIG. 6 diagrammatically shows an exploded view of a second embodiment of a sports shoe according to the invention.

According to another embodiment shown in FIGS. 6 and 7, the shoe 200 can further include a posterior shell 50 that is rigid and hollow, and integrated into the posterior part 13 of the sole 10 so as to receive the mounting midsole 30, and more particularly the posterior part 33 of the mounting midsole 30.

This posterior shell 50 is made of a plastic material, more preferably rigid, of the thermoplastic or thermosetting type possible reinforced with fibres of the nylon, glass or other type, and forms a flat support at its upper face to receive the posterior part 33 of the mounting midsole 30.

The posterior shell 50 is realised sufficiently rigid to not be deformed under the weight of the athlete.

The posterior shell is advantageously formed by a bottom wall 51 and by a peripheral lateral wall 52 extending vertically from the bottom wall 51. Thus, the walls 51, 52 of the shell 50 form an enveloping shell to receive the posterior part 33 of the mounting midsole 30, as well as the cushioning element 40.

The posterior shell 50 thus makes it possible to further optimise the maintaining and the rigidity of the shoe 200, in particular at the posterior part and around the cushioning element 40.

The sports shoe according to the invention that advantageously combines an mounting midsole 30 made of hard material (having a hardness greater than 20 Shore D) and a cushioning element at the heel made of soft material, less than 50 Shore A (for example made of foam materials, elastomer, etc.) has many advantages.

At the biomechanical level, the shape of the mounting midsole 30 combined with a cushioning element bearing on the upper face of the mounting midsole and forming a riser makes it possible to position the foot according to an optimum angle for taking support. Thus, right from the taking of support and during the cushioning phase, the foot flexing of the ankle is passively accentuated under the stress, it is controlled by the calf substantially. Controlling the angle of the foot during the taking of support by the optimised positioning of the foot provided by the shoe according to the invention makes it possible to store the energy (in particular at the arch of the central part 34 of the mounting midsole 30) that will be returned during the next propulsion phase, mike a spring.

The sports shoe according to the invention constitutes an elementary link in the prevention, protection, and improvement of the performance of the athlete.

It further has the following additional advantages:

- better cushioning of the reaction force to the ground and of the shock wave that stems therefrom during the taking of support;
- an increase in yield; indeed, during the taking of support, an increase in elastic potential energy is stored at the central part of the mounting midsole and is returned during the thrust;
- an activation of the traction right from the taking of support and decrease in the slowing down phase; the hamstrings (posterior muscles of the thigh) contract right at the taking of support;
- an activation of the forefoot interface that neutralises the camber of the ground; the torsion complex between the forefoot and the rearfoot makes it possible to absorb the lateral movements of the ground which are sources of instability (loss of balance, falling, sprains, etc.)
- a reinforcing of the protection of the knee from all standpoints; the activation of the calf (the soleus) right from the taking of support fights against the file drawer phenomenon (anterior sliding of the tibia under the femur responsible for the stretching of the anterior cruciate ligament), the activation of the torsion complex between the forefoot and the rearfoot provides a more substantial margin for manoeuvre in case of loss of balance;
- reinforcing the protection of the ankle; the forefoot taking of support further reinforces the stabilising muscles;
- passive participation in the propulsion phase;
- optimisation of the stability of the leg and consequently of the support;

the mechanical balance generated by the swinging of the arms which completes the stabilising muscle system of the leg;

optimisation of the stability of the body as a whole; the harmonisation and the balance of the stresses linked to the setting into motion of the different parts of the body;

better cushioning of the reaction force to the ground and of the shockwave that stems therefrom during the taking of support;

reinforcing the protection of the knee in the antero-posterior plane; the activation of the calf (the soleus) right from the taking of support fights against the file drawer phenomenon (anterior sliding of the tibia under the femur responsible for the stretching of the anterior cruciate ligament), activation of the hamstrings (principle of traction right at the taking of support) favours the reinforcing thereof and thus increases the protection of the anterior cruciate ligament.

It goes without saying that other embodiments can be considered, without leaving the scope of the invention, the latter being in no way limited to the examples described and shown.

In particular, although the embodiments described hereinabove concern a running shoe, the invention can also relate to shoes provided for the practice of other sports such as football, rugby, American football, baseball, golf, trail running, walking, hiking or other sports.

Thus, the invention also has for object a sports shoe with rigid cleats, such as a football, rugby, etc. shoe, having rigid cleats (i.e. that cannot be deformed by hand) moulded or to be screwed.

Rigid cleats means cleats that have a hardness greater than 20 shore D.

Reference shall be made for example to document FR2945917 and FR2967874 for a complete description of such a shoe with cleats.

The characteristics described hereinabove for a walking or running shoe in reference to FIGS. 1 to 7 remain applicable for a shoe with cleats.

The invention claimed is:

1. A sports shoe comprising a stem, a mounting midsole and a sole, the mounting midsole being secured to the sole, extending in a longitudinal direction and having an anterior part that is adapted to receive the forefoot, a central part that is adapted to receive the midfoot and a posterior part, wherein the posterior part and the central part of the mounting midsole are made of a rigid material and wherein the sports shoe has a removable heel-piece positioned in the posterior part of the mounting midsole, said removable heel-piece being adapted to cushion and receive the heel, wherein a flexing zone extending on either side of the mounting midsole of the anterior part of the mounting midsole is made of a soft material, wherein the anterior part of the mounting midsole comprises at least one groove or cut-out creating a primer in order to favour the folding of the anterior part, and wherein said at least one groove or cut-out is arranged in the flexing zone dimensioned and oriented in such a way as to correspond to a contact zone receiving all the metatarsal heads of the foot.

2. The sports shoe according to claim 1, wherein the posterior part and the central part of the mounting midsole are made of a material that has a hardness greater than or equal to 20 Shore D.

3. The sports shoe according to claim 1, wherein the posterior part and the central part of the mounting midsole are made of a thermoplastic or thermosetting material.

4. The sports shoe according to claim 1, wherein the removable heel-piece is made of a material that is more flexible than the rigid material of the central part and of the posterior part of the mounting midsole.

5. The sports shoe according to claim 1, wherein the removable heel-piece is made of a material that has a hardness less than or equal to 50 Shore A.

6. The sports shoe according to claim 1, wherein the removable heel-piece has a thickness comprised between 1 and 25 mm forming a posterior elevation of the heel with respect to the forefoot.

7. The sports shoe according to claim 1, wherein the removable heel-piece rests on an upper face of the posterior part of said mounting midsole.

8. The sports shoe according to claim 1, wherein the central part of the mounting midsole comprises an upper profile and a lower profile that are curved, in such a way that the central part forms an arch extending between the posterior part and the anterior part of the mounting midsole.

9. The sports shoe according to claim 1, wherein the central part of the mounting midsole comprises a curved upper profile configured to hug the shape of the arch of the foot.

10. The sports shoe according to claim 1, wherein the central part of the mounting midsole has cushioning and rebound properties.

11. The sports shoe according to claim 1, wherein the anterior part of the mounting midsole is formed by a textile material or a piece of leather or a cardboard material.

12. The sports shoe according to claim 1, wherein the sole comprises an anterior part, a central part and a posterior part, said sole having in the anterior part a preferred flexing zone extending in an oblique direction with respect to the longitudinal direction of the sports shoe.

13. The sports shoe according to claim 12, wherein said preferred flexing zone arranged in the sole is dimensioned and oriented in such a way as to be located as a projection of the metatarsal phalangeal heads of the foot.

* * * * *